US009291008B2

(12) United States Patent
Koch et al.

(10) Patent No.: US 9,291,008 B2
(45) Date of Patent: Mar. 22, 2016

(54) DUAL PIPE ROD ASSEMBLY SECTION, HORIZONTAL DRILLING DEVICE AND PROBE HOUSING

(75) Inventors: Elmar Koch, Eslohe (DE); Sebastian Fischer, Lennestadt (DE)

(73) Assignee: TRACTO-TECHNIK GMBH & CO. KG, Lennestadt (DE)

( * ) Notice: Subject to any disclaimer, the term of this patent is extended or adjusted under 35 U.S.C. 154(b) by 778 days.

(21) Appl. No.: 13/485,251

(22) Filed: May 31, 2012

(65) Prior Publication Data

US 2013/0140087 A1 Jun. 6, 2013

(30) Foreign Application Priority Data

Jun. 1, 2011 (DE) ..... 10 2011 103 220

(51) Int. Cl.

| | |
|---|---|
| ***E21B 17/18*** | (2006.01) |
| ***E21B 47/01*** | (2012.01) |
| ***E21B 47/024*** | (2006.01) |
| ***E21B 7/00*** | (2006.01) |
| ***E21B 7/04*** | (2006.01) |
| ***E21B 7/20*** | (2006.01) |
| ***E21B 17/10*** | (2006.01) |

(52) U.S. Cl.

CPC ..... *E21B 17/18* (2013.01); *E21B 7/002* (2013.01); *E21B 7/046* (2013.01); *E21B 7/20* (2013.01); *E21B 17/1064* (2013.01); *E21B 47/01* (2013.01); *E21B 47/011* (2013.01); *E21B 47/024* (2013.01)

(58) Field of Classification Search

CPC ..... E21B 47/01; E21B 47/011; E21B 47/02; E21B 47/022; E21B 17/1064; E21B 17/18; E21B 7/002; E21B 7/20; E21B 7/046

USPC ..... 166/250.11, 255.2; 175/45; 464/29

See application file for complete search history.

(56) References Cited

U.S. PATENT DOCUMENTS

| | | | | |
|---|---|---|---|---|
| 5,265,682 | A * | 11/1993 | Russell et al. | 175/45 |
| 5,646,611 | A * | 7/1997 | Dailey et al. | 340/853.6 |
| 5,833,015 | A | 11/1998 | Hesse et al. | |
| 6,370,784 | B1 * | 4/2002 | Hunter et al. | 33/395 |
| 7,528,946 | B2 * | 5/2009 | Gunsaulis | 356/241.3 |
| 7,725,263 | B2 * | 5/2010 | Sugiura | 702/9 |
| 7,726,028 | B2 | 6/2010 | Koch et al. | |
| 7,824,130 | B2 | 11/2010 | Koch et al. | |
| 8,075,224 | B2 | 12/2011 | Koch et al. | |
| 2004/0154390 | A1 * | 8/2004 | Baustad | 73/152.55 |
| 2005/0193811 | A1 * | 9/2005 | Bilby et al. | 73/152.43 |
| 2006/0137196 | A1 | 6/2006 | Dimitroff | |
| 2006/0164917 | A1 * | 7/2006 | Ganesan et al. | 367/83 |
| 2007/0030007 | A1 * | 2/2007 | Moore | 324/333 |

(Continued)

FOREIGN PATENT DOCUMENTS

| | | |
|---|---|---|
| DE | 196 13 788 C1 | 3/1998 |
| EP | 0 806 542 A2 | 11/1997 |
| GB | 2393749 | 4/2004 |

*Primary Examiner* — Robert E Fuller

*Assistant Examiner* — Christopher Sebesta

(74) *Attorney, Agent, or Firm* — Howard IP Law Group, PC

(57) ABSTRACT

A dual pipe rod assembly section includes an inner rod section and an outer rod section, with a probe which is arranged in the dual pipe rod assembly section, a horizontal drilling device and a probe housing. The probe is arranged in the inner rod section and rotationally coupled to the outer rod section.

18 Claims, 4 Drawing Sheets

(56) References Cited

U.S. PATENT DOCUMENTS

2009/0194284 A1* 8/2009 Jahn ..... 166/298
2011/0005838 A1 1/2011 Granberg et al.
2011/0150577 A1 6/2011 Koch et al.
2011/0168286 A1 7/2011 Koch et al.
2011/0239434 A1 10/2011 Koch
2012/0138320 A1 6/2012 Koch et al.

* cited by examiner

DUAL PIPE ROD ASSEMBLY SECTION, HORIZONTAL DRILLING DEVICE AND PROBE HOUSING

CROSS-REFERENCES TO RELATED APPLICATIONS

This application claims the priority of German Patent Application, Serial No. 10 2011 103 220.0, filed Jun. 1, 2011, pursuant to 35 U.S.C. 119(a)-(d), the content of which is incorporated herein by reference in its entirety as if fully set forth herein.

BACKGROUND OF THE INVENTION

The present invention relates to a dual pipe rod assembly section with a probe arranged in the dual pipe rod assembly section, a horizontal drilling device and a probe housing.

The following discussion of related art is provided to assist the reader in understanding the advantages of the invention, and is not to be construed as an admission that this related art is prior art to this invention.

The invention relates to a dual pipe rod assembly section including an inner rod section and an outer rod section, having a probe arranged in the dual pipe rod assembly section a horizontal drilling device and a probe housing.

In rod assembly based drilling in the ground in particular for the purpose of generating so called horizontal bore holes which extend substantially parallel or at a relatively small inclination angle relative to the ground surface, a drill head is driven by means of a rod assembly by a drive device which is arranged above ground or in an excavation pit. The rod assemblies used in this case are made of individual pipe rod sections which are connected to one another, and which—corresponding to the drilling course—are placed at the rear end of the already drilled rod and connected to the latter.

For rock drilling, i.e. a drilling in rock or rocky earth formations substantially two different designs of rock drilling devices are established in the market place which function without a fast rotation of the rod assembly which is in contact with the wall of the bore hole.

A first one of these designs is based on the use of an in-hole motor, which drives the drill head directly and not via the drill rod assembly. Rather, the unit of drill head and in hole motor is fixed to the front side of the drill rod assembly via which the required axial pressure for driving the bore hole forward is applied. As in-hole motors so called mud motors are commonly used in which a drive fluid is conducted though a turbine under high pressure to cause the rotation.

The second common design for rock drilling devices is based on the use of a dual rod assembly which in the following is also referred to as dual pipe rod assembly. In these machineries, the drill head is additionally rotatingly driven via an inner rod assembly of the dual pipe rod assembly by a driving device which is arranged above ground or in an excavation pit, and which also ensures the forward drive of the motor. The inner rod assembly is rotatably supported in an outer rod assembly of the dual pipe rod assembly.

In the known rock drilling devices with dual pipe rod assembly the individual rod sections of the outer rod assembly as well as the inner rod assembly are either bolted to one another or inserted into one another.

For controlling the position and the directional accuracy during drilling, it is possible to install a (measuring) probe in a housing in or on the drill head, which during drilling allows a maximally accurate position determination from above ground. The determination of the position of the drill head is usually achieved by a measuring probe which emits an electromagnetic wave. Beside the determination of the inclination angle and the rolling of the probe as well as the extension "right/left" by a receiver carried along by a user above ground ("Walk-Over-Method") further data can be emitted by the probe via the electromagnetic wave.

The probes or respectively, sensors require a supply voltage, which can be supplied via accumulators which are arranged on the drill head or a cable line to an external voltage source—as it is described for example in U.S. Pat. No. 5,833,015 A. The runtime of accumulators is limited which can lead to problems when using accumulators. The use of cables on the other hand poses the risk that because of strong mechanical stress, the cable can be damaged. When using a probe which is connected to a cable in a dual pipe rod assembly, it is known to guide the cable in the internal space between the inner rod assembly and the outer rod assembly, wherein the probe is fastened to the outer housing in the annulus.

It would therefore be desirable and advantageous to provide an improved dual pipe rod assembly section with a probe arranged in the dual pipe rod assembly section, an improved horizontal drill device with such a dual pipe rod assembly section and in particular a probe housing for a dual pipe rod assembly, in which the service time is increased and a simple mounting is nevertheless possible.

SUMMARY OF THE INVENTION

According to one aspect of the present invention, a dual pipe rod assembly section can include an outer rod section an inner rod section, and a probe arranged in the inner rod section, wherein the probe can be rotatingly coupled to the outer rod section.

According to another aspect of the present invention, a horizontal drilling device can include a dual pipe rod assembly section which can include an outer rod section an inner rod section, and a probe arranged in the inner rod section, wherein the probe can be rotatingly coupled to the outer rod section.

According to another aspect of the present invention, a probe housing for a dual pipe rod assembly of a horizontal drilling device can include a tube shaped section made of a nonmagnetic material and being in surrounding relationship with a probe, and connection parts arranged at end sides of the tube shaped section, each connection part having an end with which it is connectable to an inner rod section of the dual pipe rod assembly and/or to a drill head of the dual pipe rod assembly, wherein each of the connection parts can further have a receptacle for a bearing for rotating support in an outer rod section of the dual pipe rod assembly, wherein the probe is supported in the tube shaped section for rotation relative to the connection parts, and wherein the probe is rotationally coupled to the outer rod section.

The invention is based on the idea, to provide a possibility for the protection of a probe and in the case of a probe connected to a cable for the protection of a corresponding cable for a dual pipe rod assembly, in which the probe and the cable are protected, whereby the service life of the dual pipe rod assembly is increased, the accuracy however, of the measurements of the probe in the dual pipe rod assembly and/or the transmission of the measurement values during the drilling can nevertheless be assessed very accurately.

This is achieved according to the invention in that the probe is arranged in the inner rod section, and thus is surrounded by the inner rod section and protected, however the probe is still decoupled from the inner rod section, i.e. the inner rod assembly which carries or receptively drives the drill head and is rotatingly coupled with the outer rod assembly. The probe is arranged inside the inner rod assembly and the cable provided for voltage supply to the probe can be guided inside the inner rod assembly. A strong mechanical stress on the cable and/or the probe is eliminated. The service life of the dual pipe rod assembly with the probe arranged in the latter is increased.

The terms inner rod section and outer rod section relate to a section of the inner rod assembly or respectively, the outer rod assembly. The rod sections can be connected to one another via a bolting or by inserting the rod sections into one another.

When the probe is described to be arranged inside or in the inner rod section this means that the probe is located in a region which is defined by the outer cross section of the inner rod section. The probe thus can also be arranged on the inner rod section, if the probe is located within the border which is defined by the outer circumference of the inner rod section. Particularly preferably, the probe is arranged within the inner rod section in such a manner that the probe and/or the probe housing do not come into contact with the inner rod section so as to co-rotate with the inner rod section.

A dual pipe rod assembly which according to the invention has an inner rod section and an outer rod section with a probe arranged in the dual pipe rod assembly section thus has a probe which is arranged in the inner rod section of the dual pipe rod assembly section and rotatingly coupled to the outer rod section. While the inner rod section is rotatable relative to the outer rod section, the probe is arranged in the inner rod section so that it co-rotates with the outer rod section. The probe follows the rotational movement of the outer rod section; the rotational movement of the outer rod assembly is imposed on the probe. The rotational speed of the outer rod assembly is significantly smaller than the speed of the inner rod assembly in a dual pipe rod assembly.

In order to enable an additional protection of the probe or respectively of the cable which is provided to be connected to the probe and to increase the service life of the dual pipe rod assembly, the probe is preferably arranged centrically in a housing in the inner rod section, which also achieves an overall small design, which allows carrying out smaller bore hole diameters. Faster and cheaper pilot drillings can be carried out. Further, a centric mounting of the probe causes the latter to always register the same field strength to the surface, no deviations exist in contrast to the previous case when the field strength was weakened by the output shaft as a result of a lateral mounting of the probe and no symmetrical field was possible. Contrary to the widely held opinion, the probe has surprisingly been shown to be able to be arranged centrically, which allows achieving a greater accuracy of the measurement.

Preferably, the dual pipe rod assembly section has at least two magnets for the rotational coupling of the outer rod section and the probe, one of which magnets is arranged in the outer rod section and one in the inner rod section on the probe or respectively, a probe housing, wherein the magnets are oriented toward one another so that the at least two magnets interact with one another, i.e. attract one another in order to achieve the rotational coupling. By using magnets for achieving the rotational coupling, a contactless interaction of probe position and outer rod section is established in which components which may engage with one another and are subjected to mechanical stress or to wear can be omitted. Preferably, the magnet which is arranged on the inner rod section on the probe can be an electromagnet, in order to increase the interaction. In order to increase the interaction, neodymium-magnets can be used for the magnet in the outer rod section as well as for the magnet in the inner rod section.

In addition, the probe can be preferably be arranged between two end-side connection parts in a ring shaped section of a nonmagnetic material of the inner rod section. This allows ensuring a simple mounting, wherein the ring shaped section which is made of a nonmagnetic material in particular constructed of interconnected layers of carbon fibers, allows an accurate measuring of the position and/or direction. The nonmagnetic material is preferably an antimagnetic pipe or a CFK-pipe; such materials have also proven useful for transmitting great forces as they are required in the inner rod assembly. This allows achieving a long service life. The connection parts can be rotatably supported in the outer rod section. The support is preferably realized via a rolling bearing, in particular a low-maintenance rolling bearing. Rotatably supporting the connection parts in the outer rod section allows a decoupling of the rotational movement of the outer rod assembly and the inner rod assembly.

It is further preferred that the tube shaped section of the inner rod section is connected to the connection parts via a connection element, particularly preferably an bonding sleeve, which allows a rotationally fixed rigid connection, which allows achieving a rotational coupling with the outer rod section by decoupling the rotational movement of the inner rod assembly, with which an adjustment via variable dimensions of the bonding sleeve is established. The bonding sleeve enables an adhesive bond by means of an adhesive, to carry out a low-temperature joining to achieve a connection which has a long service life.

For a simple structural configuration for decoupling the rotation of the inner rod assembly the probe is supported in a receptacle for rotation relative to the connection parts. The rotation of the inner rod assembly is thus enabled by the connection parts which are supported for rotation relative to the inner rod assembly, which connection parts have themselves a rotatably supported receptacle for the probe, wherein preferably low-maintenance rolling bearings are used.

In a preferred embodiment of the present invention, the rotational coupling of probe and outer rod assembly in the tough and harsh conditions during use in the ground is achieved via a magnetic coupling of at least two magnets, wherein at least one of the magnets is fastened to the receptacle for interacting with a magnet which is fastened on the outer rod assembly. Via the magnets a force transmission or respectively, a force exchange is possible without moving elements.

For simple mounting in an opening of the outer rod assembly, the magnet which is fastened to the outer rod section can be insertable into an opening which is adjusted to the outer diameter of the magnet, which opening is closable via a closing element which is subsequently insertable from the outside. The arrangement of the magnet on/in the outer rod section is thus achieved via a connection which is realized inside the sheath of the outer rod section. The magnet on the outer rod assembly is located in the sheath of the outer rod section, without coming into contact with the soil. In particular, beside a clamping or a bonding closure, a screwable locking screw can be provided as closing element, which locking screw can be screwed into an inner threading of the sheath of the outer rod assembly which inner threading is provided in at least a partial area of the opening. The locking screw allows a simplified exchange of a magnet.

Further, slots can be provided which are adjusted to the arrangement of the probe in the inner rod section, which slots allow electromagnetic waves emitted by the probe to exit independent of the material of the outer rod section.

For additional protection of the probe of the measurement system for determining position and direction for the drill head, a cable connection for the probe is preferably arranged centrically in the inner rod assembly, which because of the centric location leads to the fact that no rotation forces act on the cable during operation of the dual pipe rod assembly.

In a preferred embodiment, the connection part which faces away from the drill head has a rotation opening for the cable, whereby a mechanical rotation movement of the connection part is decoupled from the traversing cable, which increases the service life of the dual pipe rod assembly section or respectively the maintenance intervals.

Preferably, bore holes which extend in the outer rod section for transporting drilling fluid are formed, whereby due to the separation of the drilling liquid or respectively drilling fluid from the probe which is arranged in the dual pipe rod assembly the stress exerted on the probe is decreased, because the pressurized drilling fluid does not come into contact with the probe.

In a further preferred embodiment of the dual pipe rod assembly section according to the invention the outer rod section is made of a non magnetic material, which increases the quality of the direction and/or position determination of the drill head or respectively, the probe.

A dual pipe rod assembly section according to the invention can preferably be used as a dual pipe assembly section for a horizontal drilling device.

Further, a probe housing for a dual pipe rod assembly of a horizontal drilling device is created, which has end-side arranged connection parts, which each are connectable end-side to an inner rod section and/or the drill head. The connection parts have a receptacle for a bearing for rotatable support in an outer rod section, and a tube shaped section of a non-magnetic material which surrounds the probe is formed between the connection parts, in which tube shaped section the probe is supported for rotation relative to the connection parts, wherein a rotational coupling of probe and outer rod section is established.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
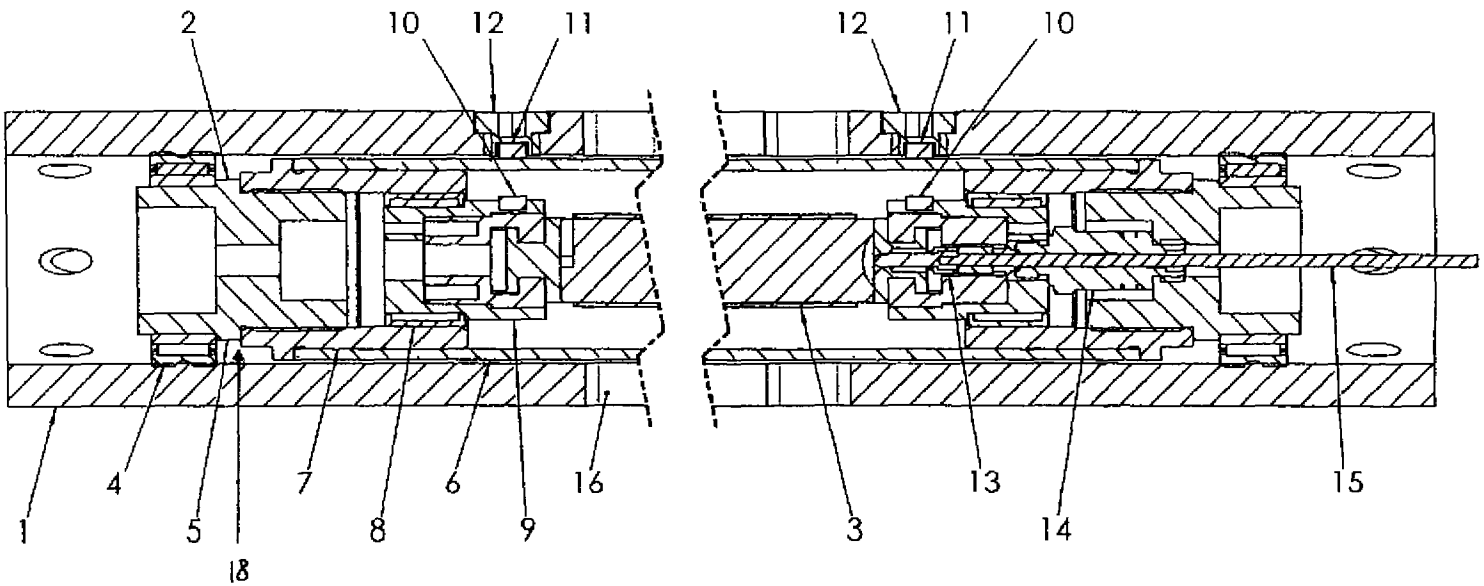
FIG. 1 shows in a schematic representation a dual pipe rod assembly according to the invention in a longitudinal section.

Throughout all the Figures, same or corresponding elements may generally be indicated by same reference numerals. These depicted embodiments are to be understood as illustrative of the invention and not as limiting in any way. It should also be understood that the figures are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Turning now to the drawing, and in particular to FIG. 1, there is shown a dual pipe rod assembly section according to the invention, as it can be used for a rotation controlled rock drilling system of an HDD-drilling system. HDD here denotes a "Horizontal Directional Drilling". The dual pipe rod assembly section has an outer rod section 1 and an inner rod section 2. A probe 3 is arranged in the inner rod section 2. The probe 3 is centrically arranged in a housing 18 in the inner rod section 2.

For decoupling the rotational movement of the inner rod section 2 from a rotational movement of the outer rod section 1, the inner rod section 2 is supported in the outer rod section 1 by bearings 4 for rotation relative to the outer rod section 1. The bearings 4 are provided between the outer rod section 1 and connection parts 5 which are arranged end-side to the inner rod section 2. The inner rod section 2 is supported via the bearings 4 for rotation relative to the outer rod section 1, wherein the inner rod section 2 is fixed non shiftable relative to the outer rod section 1.

A tube shaped section 6 made of a nonmagnetic material extends between the end-side connection parts 5. The tube shaped section 6 surrounds the probe 3. For connecting the tube shaped section 6 to the bearings 4, connection elements 7 are provided between the connection part 5 and the tube shaped section 6, which connection elements 7 can be configured in the form of bonding sleeves. The connection elements 7 embrace the connection part 5 in a partial section and are themselves embraced in a region by the tube shaped section 6.

The probe 3 is rotatably supported in the tube shaped section 6. The rotatable support allows the probe 3 to rotate relative to the inner rod section 2. The rotatable support of the probe 3 relative to the inner rod section 2 is achieved by bearings 8 which are provided between the connection element 7 and end-side receptacles 9 for the probe 3. The receptacles 9 are thus rotatably supported in the connection elements 7 via the bearings 8 and can thereby rotate freely.

A magnet 10 is provided on at least one receptacle 9 at a defined position on or respectively, in the outside. The magnet 10 can for example be inserted into the receptacle 9 from outside. At a predetermined position which corresponds to the position of the magnet with regard to the longitudinal axis of the inner rod section 2, at least one further magnet 11 is provided in the outer rod section 1, which magnet 11 interacts with the magnet 10. The magnetic poles of the magnets 10, 11 are oriented so that the magnets 10, 11 attract one another. In this way, the receptacle 9 and with this the probe 3 which is connected to the receptacle 9 in a rotationally fixed manner can always follow the rotational movement of the outer rod section 1. The probe 3 is rotationally coupled to the outer rod section.

Figure 2:
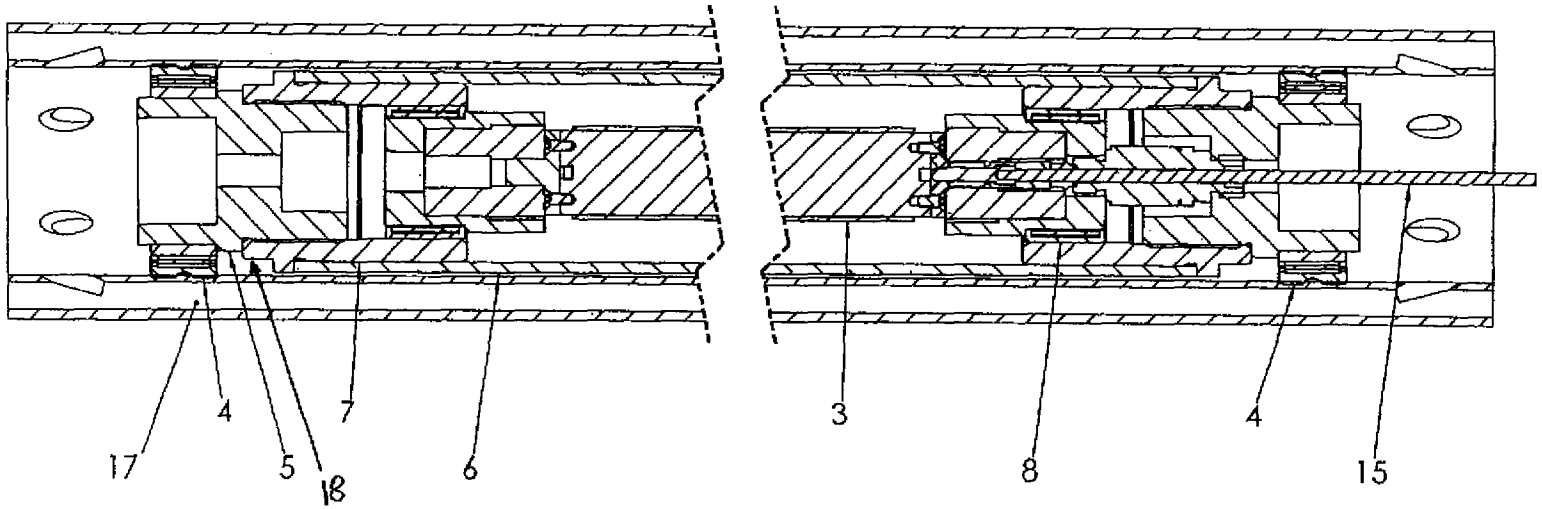
FIG. 2 shows the dual pipe rod assembly according to FIG. 1 in a view rotated by 90.
Figure 3:
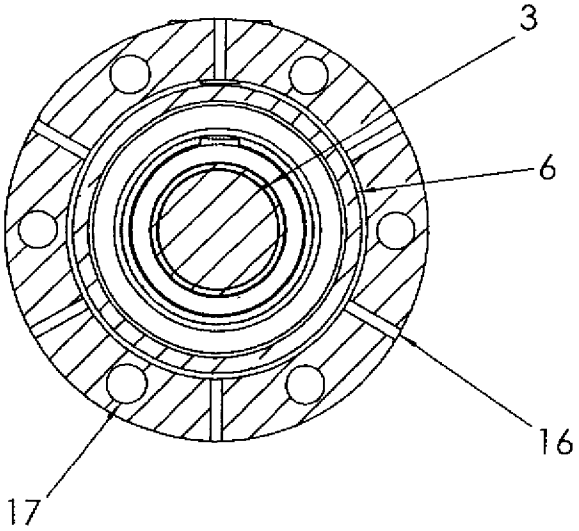
FIG. 3 shows the dual pipe rod assembly section according to FIG. 1 in a cross section in the region for slot's in the outer rod section.
Figure 4:
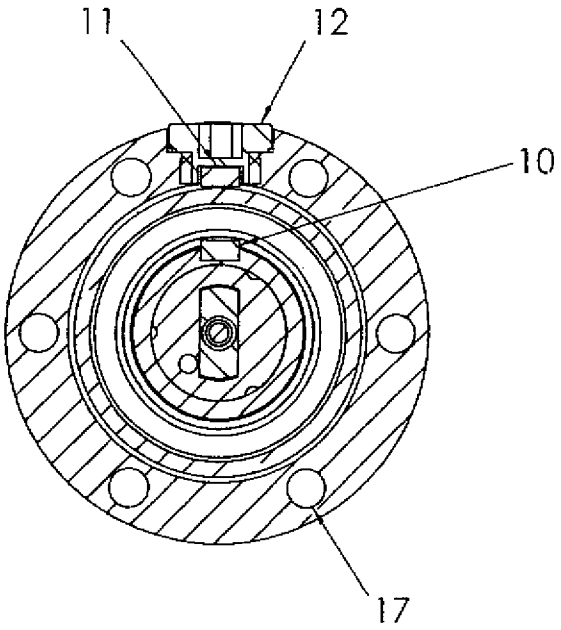
FIG. 4 shows the dual pipe rod assembly section according to FIG. 1 in a cross section in the region of magnets which are arranged toward each other in the outer rod section and inner rod section.

While the torque for the drive of the drill head which in the representation of FIGS. 1 and 2 can be attached to the connection part 5 on the left side of the inner rod assembly 2, is provided via the inner rod assembly 2 of the dual pipe rod assembly and transmitted to the connection elements 7 and the tube shaped section 6 via the connection parts 5, the probe 3 can rotate independent there from in the inner rod section 2. The connection parts 5, the connection elements 7 and the tube shaped section 6 are rotatable relative to the probe 3 and the outer rod section 1, without co-rotation of the probe 3 and the outer rod section 1. The interaction between the magnets 10, 11 causes the probe 3 to follow the rotational movement of the outer rod section 1. The magnetic interaction establishes a rotational coupling of the receptacle 9 and the probe 3 which is connected to the receptacle 9 in a rotationally fixed manner, relative to the outer rod section 1. The probe 3 is located in a space which is defined between the two connection elements 7 and within the tube shaped section 6, wherein due to the rotatable support on the connection elements 7 the probe 3 can rotate independent of the inner rod assembly 2. While the rotational coupling of the inner rod sections to one another and to the drill head is achieved via the connection elements 7 and the connection part 5, the bearings 8 offer a possibility for rotationally coupling the rotation of the probe 3 relative to the inner rod assembly 2, even though the probe 3 is located within the inner rod assembly 2.

The magnet 11 is inserted into an opening of the outer rod section 1, which opening has at least in a partial area thereof an internal threading and can be closed via a locking screw 12. The head of the locking screw 12 is preferably flush with the outer surface of the outer rod section 1 or lies underneath this surface. The magnet 11 is connected to the locking screw 12 or is inserted into the locking screw 12 with its end side.

For connecting the probe 3 which is arranged centrically in the inner rod section 2, a passage with a cable connection 13 is provided, which passage extends through the receptacle 9 which is located at a distance from the drill head, wherein a rotary bushing 14 is provided for a cable 15. The cable connection 13 of the probe 3 is thus connected to a rotary bushing 14, so that the cable 15 which leads to the drilling device cannot become twisted. The rotary bushing 14 is oriented centrically relative to the receptacle 9 and the connection part 5. The cable 15 is guided centrically in the inner rod section 2 and the outer rod section 1.

The outer rod section 1 has two slots 16 in the region of the probe 3, which slots 16 preferably extend over the region of the probe 3 or respectively, the probe housing 18. Multiple slots 16 are provided adjacent one another in longitudinal direction of the outer rod section 1. The slots 16 are distributed radially in the outer rod section 1 and have preferably equal angular distances between one another.

For transporting drilling fluid, in particular bentonite containing fluid, bores 17 are provided in the outer rod section 1, which bores 17 extend in longitudinal direction of the outer rod section 1. Multiple bores 17 are provided which are circumferentially distributed in the outer rod section 1, and which have equal angular distances between one another.

While the invention has been illustrated and described in connection with currently preferred embodiments shown and described in detail, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

What is claimed is:

1. A dual pipe rod assembly section comprising:

an outer rod section;

an inner rod section independently rotatable with respect to the outer rod section;

a probe arranged in the inner rod section, wherein the probe is independently rotatable with respect to the inner rod section and is coupled to the outer rod section to co-rotate with the outer rod section; and a housing disposed in the inner rod section, wherein the probe is centrically arranged in the housing and wherein the housing is independently rotatable with respect to the inner rod section.

2. The dual pipe rod assembly section of claim 1, further comprising at least one magnet disposed in the inner rod section and coupled to the probe to co-rotate with the probe, and at least one other magnet disposed in the outer rod section, said magnets being in interacting relationship with one another for coupling the probe to the outer rod section.

3. The dual pipe rod assembly section of claim 1, further comprising two connection parts, wherein the inner rod section has a tube shaped section made of a nonmagnetic material, said tube shaped section being arranged between the two connection parts, and wherein each of said two connection parts is supported at an end side thereof for rotation relative to the outer rod section.

4. The dual pipe rod assembly section of claim 3, wherein the tube shaped section is connected to the connection parts via a connection element.

5. The dual pipe rod assembly section of claim 4, wherein the connection element is constructed as a bonding sleeve.

6. The dual pipe rod assembly section of claim 3, further comprising a receptacle for supporting the probe for rotation relative to the connection parts.

7. The dual pipe rod assembly section of claim 3, further comprising a cable connection for the probe, said cable connection being arranged centrically in the inner rod section, wherein one of the two connection parts has a rotary bushing for guiding the cable through the first connection part, and faces away from an end of the dual pipe rod assembly on which a drill head is disposed.

8. The dual pipe rod assembly section of claim 1, wherein the outer rod section is provided with slots arranged radially outward from the probe.

9. The dual pipe rod assembly section of claim 1, wherein the outer rod section is provided with bores, said bores extending in the outer rod section for transporting drilling fluid.

10. The double pipe rod assembly section of claim 1, wherein the outer rod section is formed from a nonmagnetic material.

11. The dual pipe rod assembly section of claim 1, wherein the outer rod section at least partially surrounds the inner rod section.

12. The dual pipe rod assembly section of claim 11, further comprising at least one magnet coupled to the probe to co-rotate with the probe, and at least one other magnet disposed in the outer rod section, said magnets being in interacting relationship with one another for coupling the probe to the outer rod section.

13. A dual pipe rod assembly section comprising:

an outer rod section;

an inner rod section;

a probe arranged in the inner rod section, wherein the probe is coupled to the outer rod section to co-rotate with the outer rod section; and a receptacle for supporting the probe for rotation, wherein at least one magnet is fastened on the receptacle, and wherein at least one other magnet is fastened on the outer rod section.

14. The dual pipe rod assembly section of claim 13, wherein the at least one other magnet is insertable in an opening of the outer rod section, said opening being adjusted to an outer diameter of the at least one other magnet and closable via a locking element.

15. The dual pipe rod assembly section of claim 14, wherein at least a part of the opening is provided with an internal threading, for threadedly receiving a locking element.

16. The dual pipe rod assembly section of claim 15, wherein the locking element is constructed as a locking screw.

17. A probe housing for a dual pipe rod assembly of a horizontal drilling device comprising:

a tube shaped section made of a nonmagnetic material and being in surrounding relationship with a probe; and connection parts arranged at end sides of the tube shaped section, each connection part having an end with which it is connectable to an inner rod section of the dual pipe rod assembly and/or to a drill head of the dual pipe rod assembly, each said connection part further having a receptacle for a bearing for rotatably supporting an outer rod section of the dual pipe rod assembly, wherein the probe is supported in the tube shaped section for rotation relative to the connection parts, and wherein the probe is coupled to the outer rod section to co-rotate with the outer rod section.

18. A dual pipe rod assembly section comprising:

an outer rod section;

an inner rod section independently rotatable with respect to the outer rod section; and a probe arranged in the inner rod section, wherein the probe is independently rotatable with respect to the inner rod section and is coupled to the outer rod section to co-rotate with the outer rod section and wherein the co-rotating relationship is caused by a magnetic coupling.

* * * * *